United States Patent [19]

Bishop

[11] 4,443,790

[45] Apr. 17, 1984

[54] BROADCAST BAND SIREN ALARM TRANSMITTER SYSTEM FOR VEHICLES

[76] Inventor: Frank A. Bishop, 6489 Claudia Dr., Brookpark, Ohio 44142

[21] Appl. No.: 43,329

[22] Filed: May 29, 1979

[51] Int. Cl.[3] ..... G08B 1/08; G08G 1/00

[52] U.S. Cl. ..... 340/539; 340/902; 455/1; 455/29

[58] Field of Search ..... 340/33, 34, 32, 539; 455/1, 27, 28, 29, 58, 102; 332/16 R, 17

[56] References Cited

U.S. PATENT DOCUMENTS

| | | | |
|---|---|---|---|
| 2,448,055 | 8/1948 | Silver et al. | 375/59 |
| 2,994,765 | 8/1961 | Adam | 325/117 |
| 3,046,472 | 7/1962 | Manahan | 325/132 |
| 3,624,507 | 11/1971 | Fukata | 325/131 |
| 3,660,811 | 5/1972 | Vail et al. | 325/132 |
| 3,784,970 | 1/1974 | Simpkin | 340/33 |
| 3,949,300 | 4/1976 | Sadler | 340/33 |

*Primary Examiner*—Donnie Lee Crosland

*Attorney, Agent, or Firm*—Sixbey, Friedman & Leedom

[57] ABSTRACT

A siren alarm on an emergency vehicle or a like warning vehicle, for transmission forwardly over a limited range along the vehicle path, of a broadcast band carrier wave modulated with a siren signal with break-in possible for voice modulation of the carrier, with the carrier frequency rapidly and continuously repeatedly swept over the broadcast frequency band, both in the AM broadcast band and FM broadcast band, thereby to produce in other vehicles, having standard broadcast radio receivers in operation, a warning signal or voice communication; optionally with warning vehicle speed responsive control of the transmitter output power for establishing a transmission range proportional to the warning vehicle speed.

24 Claims, 7 Drawing Figures

SIREN TONE GENERATOR
G
T
AM VCO
AVCO
FVCO
FM VCO
AM OUTPUT AMP
ABA
FBA
FM OUTPUT AMP
AM ANT
Aa
FM ANT
Af
PS
1500 pF
R.F. CHOKE BEAD
50μF
25V
1N1594
5Ω/5W
R.F.C.B.
500 μF
68μh
SW
+12

EV
M
VM
MA
T & SW GEN
T
VCOs
BAs
SR
D
At
WV
R (G)

(FVCO)

(FBA)

(AVCO)

(ABA)

BROADCAST BAND SIREN ALARM TRANSMITTER SYSTEM FOR VEHICLES

Often there is a reduction in effectiveness of horns, bells, sirens, or other sound emitting acoustical devices carried as warning devices by emergency vehicles, railroad trains, or the like, because in some of the other vehicles intended to be alerted by the approaching warning vehicle, the drivers or operators simply do not perceive the acoustically propagated signal for various reasons. First a driver may have his vehicle windows closed, or there is masking by his own broadcast radio on high volume, or by noise otherwise generated by his own vehicle. Particularly today with frequent installation and popularity of air conditioning equipment in passenger and commercial road vehicles, there is higher probability that many vehicles to be warned will thus have windows closed, irrespective of prevailing weather conditions. Furthermore even in vehicles with windows opened, acoustically propagated warning sounds nonetheless may still be masked by the vehicle radio, by other noise generated at the vehicle, and frequently by traffic-generated external noise. This problem of unperceived warning signals is further compounded with current designs and manufacture of numerous passenger vehicles, which provide an appreciable degree of sound-proofing to reduce outside noise entering the passenger space.

Consequently there is today an increasing probability that an emergency vehicle or other warning vehicle will encounter a vehicle or vehicles in which the drivers are not aware of the approaching warning vehicle.

In the case of railroad trains constrained to a fixed path and with long stopping distances, there is little effect upon the mode of operation of the train or locomotive except in the event of a collision, since as a practical matter there is little that the engine driver can do in approaching grade crossings, apart from actuating the locomotive bell or horn.

On the other hand, for ambulances, police cars, fire equipment and like emergency vehicles, the operators, recognizing the higher probability of collision danger, tend to drive at reduced speeds in traffic and in approaching intersections. In any event the emergency vehicle operator often finds that other vehicles are not responding to the acoustically propagated warning signal to clear a path, thus directly impeding his progress, or of course, finally may yet be involved in collisions with a vehicle whose driver did not in fact hear the emergency warning device. Thus especially for emergency vehicles, non-perception of the usual acoustical signal represents an intensifying problem which reduces their speed of response on their intended missions and their rapidity of service for public safety, maintenance of law and order, preservation of property and alleviation of human suffering.

Hence to meet this problem there have been various proposals in the prior art in some way to utilize radio transmission of warning signals from an emergency or similar vehicle to other vehicles to be warned. Thus, for example, in the Gelushia et al. U.S. Pat. No. 3,371,278, "Electronic Warning System for Vehicles", vehicles would be equipped with transceivers whereby any vehicle can become a warning vehicle to others by actuation of its warning transmitter facility, to transmit on a certain frequency a warning-signal-modulated carrier output radiated to similarly equipped vehicles, with the receiver facility tuned to the carrier frequency established for the system to be responsive to the transmitted signal.

In the Gifft U.S. Pat. No. 3,293,600, "Proximity Indicating System", a transceiver equipment of a special type is installed in each vehicle which comprises a transmitter for generating a warning signal and a proximity response unit to receive the warning; so that in fact vehicles thus equipped coming within the intended radio signal range of each other would each produce a proximity signal on the respective indicators.

The aforementioned patents and other prior art proposals have suffered the decided disadvantages entailed by the fact that particular or speciality equipment would have to be installed not only on the emergency vehicle normally so operated as to be a warning vehicle, but also then all other vehicles which were to have the supposed advantage of the system.

For these emergency warning signal systems to be effective for the intended purposes, a substantial part of the automotive vehicle population at least of an area served by the emergency vehicle would have to be thus specially equipped to receive the warning signal and give a proximity indication of some sort. To the extent that the vehicle population be not be equipped, or there be frequent passages of the area by vehicles alien thereto, the system would be to that degree ineffective. Further even to the extent of effectiveness of such pripr systems, high cost would be involved in providing not only the emergency vehicles but the other vehicles as well with particular and special equipment.

The present invention proposes a system which requires special equipment only on the emergency vehicle, train or the like as the normally warning vehicle in its usual operation, for the standard AM or FM automobile radio present in a high proportion of the automotive vehicle population serves as the receiver in warned vehicles; which receivers, by apparent habits of the driving population are usually turned on during the time of vehicle operation.

In the warning vehicle, the transmitting system on-off control is preferably coupled with the switch for the usual siren or acoustical signal generating system, so that when the latter is turned on, simultaneously the warning system of the invention is actuated. The transmitting system then includes in the preferred form in effect an AM transmitter section and an FM transmitter section feeding carriers of respective broadcast band frequency ranges to transmitting antenna means appropriately mounted at the forward end of the vehicle; and audio signal and sweep signal generating means for modulating the respective transmitted carriers (as with a siren, horn or other audio type signal) and causing the respective transmitters repeatedly to sweep rapidly and continuously over the frequencies of the AM broadcast and FM broadcast bands.

By this arrangement, hereinafter described in detail as to a specific embodiment, with high sweep rate, at the radio speaker of a warned vehicle within transmitting range of the emergency vehicle, there is produced a corresponding acoustical output as a warning signal; this irrespective of the particular station or frequency within the AM or FM broadcast bands to which the vehicle radio happens to be tuned.

Preferably the system includes microphone and voice modulating equipment advantageously with break-in arrangement circuitry, in the sense that actuation and use of the microphone in the emergency vehicle interrupts the siren or warning signal generation or application to the transmitter means, thereby to enable transmission of voice communication of instructions from the emergency or warning vehicle to other vehicles within its range to facilitate its progress, or for the like purposes.

Also with the antenna means forward of the grill, metal of a normal vehicle structure may serve as a forward reflector intensifying forward propagation of the radiated signal, especially for the FM frequencies.

Further the mechanical drive system of the warning vehicle, may be coupled to means responsive to the warning vehicle speed, which means in turn controls the transmitter means or effective output power so that if desired, the range of forward radio transmission of the warning signal can be proportioned to the emergency vehicle speed.

With a limited range of uni-directional transmission, consequent relatively low power requirement, and the particular circuitry in structures hereinafter described, the system may be installed in an emergency vehicle as equipment of relative small size and comparatively few sub-assemblies in the basic system form namely, a relatively small housing for the entire assembly of tone or siren modulation and sweep generators, both AM and FM transmitter oscillator buffer and power amplifier circuits; a preferred power supply switch or on-off system control switch coupled either directly mechanically or through relay action with the switch for the usual acoustical emergency signal equipment of the vehicle; transmitting antenna means installed in the front of the vehicle; with of course appropriate wiring harness of cables for connections between these components.

In this specification the phrases "emergency vehicle" and "siren signal" in substantive or objectival senses, are to be understood, unless context dictates otherwise, as including other vehicles where the system may in fact be found useful; and other warning signal sounds, sound patterns or devices, such as siren, bell and horn, for example.

It is the general object of the present invention to provide a warning siren system for an emergency vehicle which increases the effectiveness of its warning system by utilizing ordinary AM or FM broadcast receivers present in the vehicle population to produce locally within the warned vehicles an acoustical warning signal.

Another object is to provide a warning system effective as to a large number of the road vehicle population without special equipment installation in the latter, having a lower cost for the effectiveness attained considering both cost to warned and warning vehicles.

A further object is to provide an emergency vehicle warning system utilizing radio transmission in which a special equipment particular to the system need be installed only on the warning vehicle.

Still another object is to provide a warning system of the character described which is adaptable to a voice break-in for communications to warned vehicles or other receivers.

Still another object is to provide a warning system of the character described in which the transmitting range actually effective is proportional to the speed of the warning vehicle.

Other objects and advantages will appear from the following description and the drawings, wherein.

Figures 1, 2:
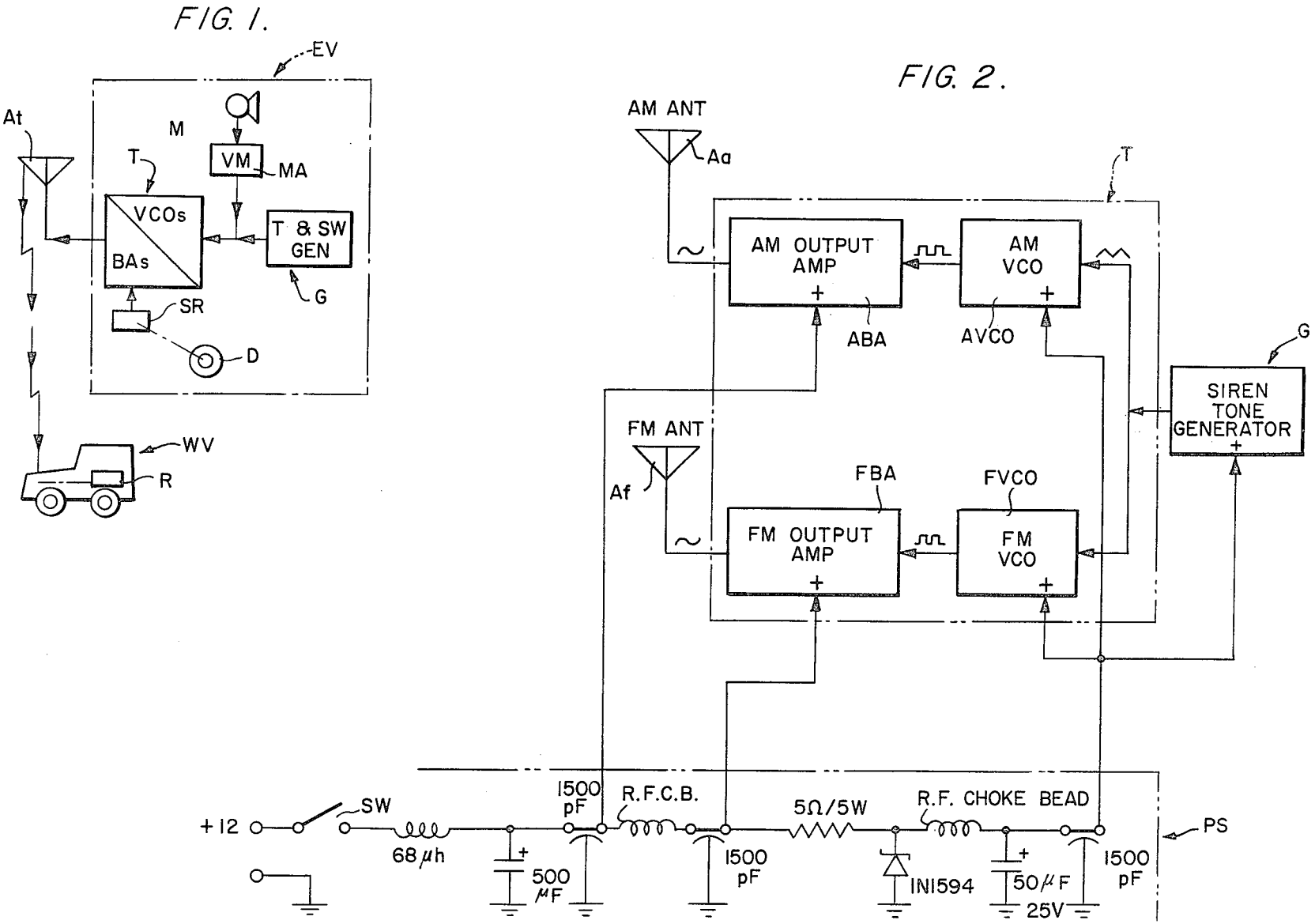
FIG. 1 is a simplified block diagram representing mainly one embodiment of the system, and which designates only larger functional component sections within the warned vehicle.
FIG. 2 is a more detailed block diagram presenting a particular form of equipment on the warning vehicle, circuitry for each of the functional blocks of which being presented in respective figures among FIGS. 3–7.

In the drawings, by a quite general block diagram FIG. 1 presents the basic means or components for a system of the invention whereby a warning signal may be generated from the warning emergency vehicle EV to a vehicle WV equipped with an AM or FM radio R, representative of the vehicles of the road population to be warned.

As presented in system block diagram FIG. 1, the warning vehicle EV (i.e., emergency vehicle, train, locomotive, even watercraft or the like) is provided with antenna means At fed by radio frequency transmitter means T, generating AM and/or FM carriers which, in response to the applied output of the tone and sweep generator G, are continually rapidly repeatedly sweeping in frequency the respective broadcast bands and effectively modulated for an audio warning signal to be produced at receivers of other vehicles. The system may provide transmission of warning signals only for the AM broadcast band or only for the FM broadcast band, though preferably both are used thus requiring corresponding dual oscillator and amplification circuitry. A sweep rate on the order of about 150 to 450 Hz will ordinarily be appropriate both for the AM and for the FM systems.

Further, in FIG. 1 there is indicated an optional feature representing microphone equipment M, with voice modulating equipment means and break-in means MA, including means which can interrupt either the operation of the signal generator G or the application of its output signal to the remainder of the system, when the microphone is operated for use by the emergency vehicle personnel to transmit voice instructions or warnings or the like through the system to warned vehicles or other receivers.

Further optional equipment representing speed responsive means SR is connected mechanically to a point D of the vehicle drive system having a motion rate proportional to the actual vehicle speed; which speed responsive means then controls the output power effectively fed from the transmitter means T to the antenna means At. Thus the transmission range is automatically regulated and proportioned to the emergency vehicle speed.

In the equipment for a warning emergency vehicle shown in the more detailed block diagram of FIG. 2, both AM and FM transmissions are provided. Hence transmitter means T includes for each type of transmission, appropriate R.F. oscillators and amplifying circuits feeding preferably respective antennas, with, however, a single sweep signal and tone generator being used for both the AM and FM transmissions. The pertinent schematics of FIGS. 3–7 present circuitry based upon the modern technology of solid state devices and of integrated circuit components often providing many functions in a single small physical component, whereby equipment requiring very little space with relatively small voltages, heat evolution and power consumption for functions achieved and the transmission ranges required. In the bottom horizontal level of FIG. 2 at PS there is presented an appropriate power supply schematic for the emergency vehicle. However, the optional features adverted to relative to FIG. 1 are not afforded in FIG. 2. Switch Sw may be coupled to a siren switch and serve as the system on-off switch.

Thus AM and FM carrier wave R.F. frequency signals produced by voltage controlled oscillator means AVCO and FVCO (see FIGS. 6 and 4) drive respective buffer and output amplifier means ABA and FBA (see FIGS. 7 and 5) feeding respectively the loaded AM antenna Aa and the FM quarter-wave antenna Af.

The sweep signal and tone generator means G (see FIG. 3), controlling the voltage controlled oscillators, has an output of a sawtooth or preferably triangular wave form applied to the VCOs to cause the frequency of each VCO output, hence the transmitted carriers, continuously to sweep repeatedly and rapidly through the respective type broadcast band, a sweep rate of 200 to 400 Hz being found quite suitable.

Figure 3:
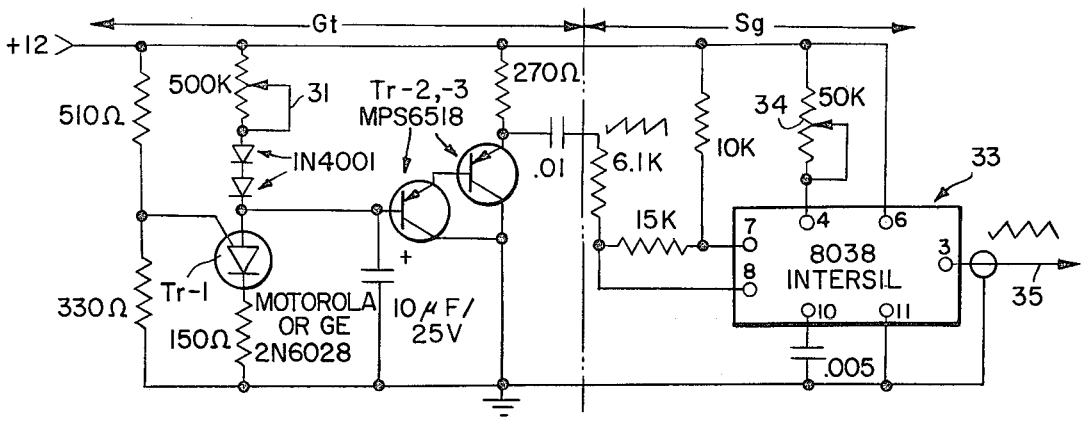
FIG. 3 is a schematic diagram for the siren tone and sweep generator.

In the sweep signal and tone generator G, as appears in FIG. 3, a sawtooth generator Gt is provided by the oscillator network including the 2N6028 unijunction silicon transistor Tr-1 and also the amplifier afforded by a pair of cascaded or directly coupled 2N6518 transistors Tr-2, Tr-3, which also provide isolation of the oscillator branch from the following sweep signal generator circuit. The sawtooth output frequency rate is set by the 500 K ohm control potentiometer or variable resistor 31, usually to about 4 Hz for a "warble" siren warning sound.

In the sweep signal generator section Sg of FIG. 3, an Intersil 8038 integrated circuit wave-form or function generator unit 33 develops a triangular wave output, of which the nominal frequency (or center freqency), e.g., 200 Hz, is selected by the 50 K ohm variable resistor or control potentiometer 34; and with the amplified 4 Hz sawtooth signal applied to the frequency modulation sweep input terminals of unit 33, more precisely the triangular output is, at the 4 Hz rate, varying in frequency centered on 200 Hz. In effect the triangular output of the sweep generator of audio frequency range is frequency modulated. This and other sweep frequency rates are each nominally referred to by the respective center frequency.

The triangle output at 35 from the generator G, i.e., from unit 33, is then applied to both the FM and AM voltage controlled oscillator circuits as a sweep frequency control voltage.

FM Transmission

Figure 4:
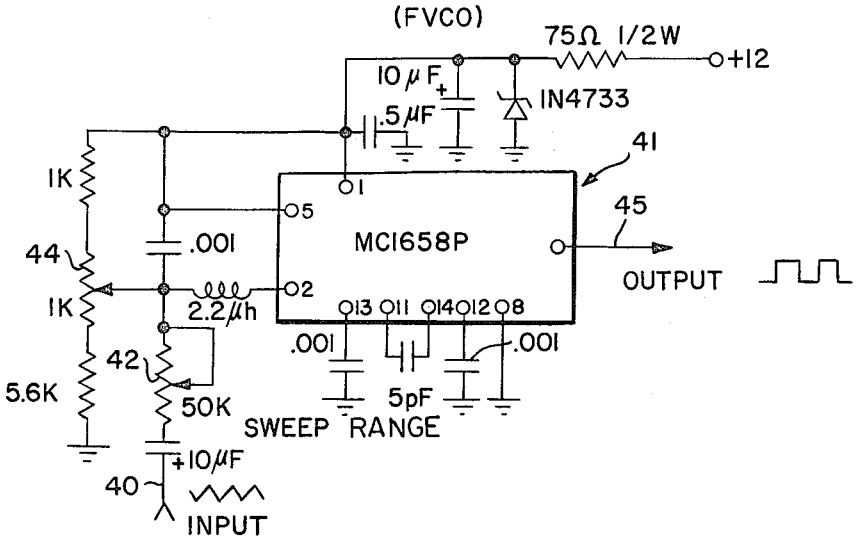
FIG. 4 is a schematic diagram of a voltage controlled R.F. oscillator for the FM transmitter.

The voltage controlled oscillator FVCO for the FM transmitter, as shown in FIG. 4, comprises basically a Motorola MC1658P voltage-controlled R.F. oscillator integrated circuit unit 41 to input terminals of which the triangular sweep signal from 35 of generator G is applied at input 40 through a coupling capacitor and variable resistor or potentiometer 42.

A bias level voltage divider network includes the 1 K control potentiometer 44 to set the center frequency of a square wave R.F. output at 45, i.e., to select the center of the band of FM broadcast frequencies to be covered; while in the input coupling network the 50 K control variable resistor or potentiometer 42 establishes the VCO sweep range, that is, the upper and the lower frequency to be covered.

In the United States, the FM center frequency is usually set to 98 MHz, with a 20 MHz range selected, that is, sweeping from 88 up to 108 and back down to 88 MHz, with a repetition rate, i.e., sweep rate, nominally of 200 Hz, derived from the triangular wave output of generator G, which of itself actually imports a rate variation or frequency modulation of 4 Hz. The square wave swept R.F. output of the unit 41 is then applied from output point 45 to drive the FM buffer amplifier section FBA of FIG. 5.

Figure 5:
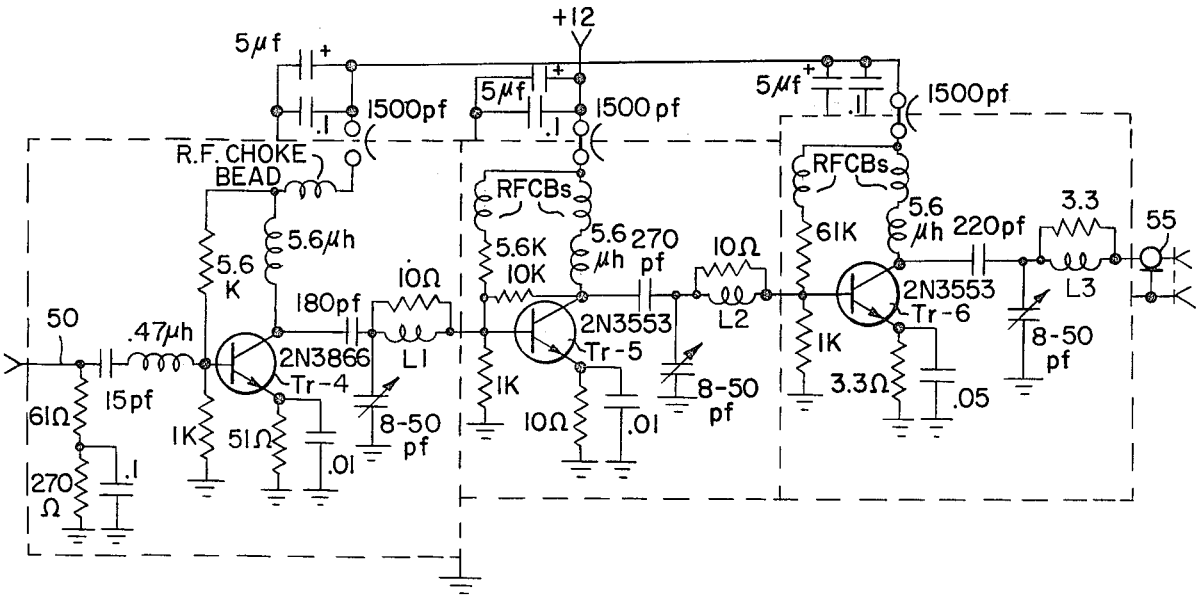
FIG. 5 is a schematic diagram of the FM transmitter with buffer amplifier and power amplifier.

In the frequency modulation buffer amplifier and power amplifier section FBA of FIG. 5, the frequency modulated and swept output from the voltage controlled oscillator FVCO is applied at 50 to an impedance matching network in the first of the three conventional broadband R.F. amplifier stages respectively including the transistors Tr-4, Tr-5, Tr-6, which stages in sum provide an output 55 a two watt R.F. output signal to be fed into a 50 ohm helical loaded broadband vertical antenna serving as the FM antenna Af of FIG. 2.

In FIG. 5, the dotted outlines represent the chassis and shielding for the successive R.F. amplifier stages.

Accordingly the transmission for the FM band warning signal has a sweep rate of 200 Hz; with modulation of 4 Hz centered on 98 MHz and sweeping between 88 and 108 MHz.

AM Transmission

Figure 6:
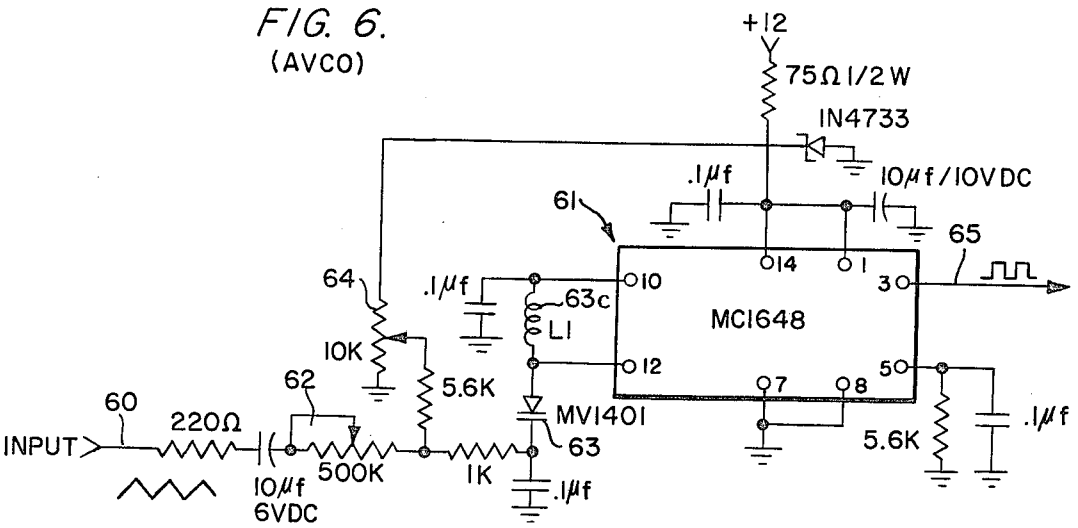
FIG. 6 is a schematic diagram of a voltage controlled oscillator for the AM transmitter.

As shown in FIG. 6, the AM voltage controlled oscillator AVCO basically comprises a Motorola MC1648 voltage controlled oscillator integrated circuit unit 61, with a series resonant network including Varicap 63, (i.e., an element varying in capacity responsive to an applied voltage), and inductor coil 63c on the frequency modulation input terminal of the unit. The triangular output of sweep generator G is applied as input at 60, through a coupling capacitor in series with the 500 K potentiometer or variable resistor 62, to the Varicap control point. The center frequency of this oscillator is set by a 10 K ohm potentiometer 64 applying a bias also to the Varicap control point. The sweep range in the AM broadcast band is controlled by the variable resistor afforded by potentiometer 62.

For the continental United States, these controls are usually set to center the oscillator output as about 1077 KHz and provide a sweep of 1070 KHz, in order to cover the AM broadcast frequency range of 535 to 1605 KHz. In other words the output frequency swings from 535 KHz up to 1605 and back to 535 KHz, again with a repetition or sweep rate of a nominal 200 Hz, but with 4 Hz frequency modulation. The R.F. output at 65 from the unit 61, also a square wave, is applied to drive the AM buffer amplifier section ABA of FIG. 7.

Figure 7:
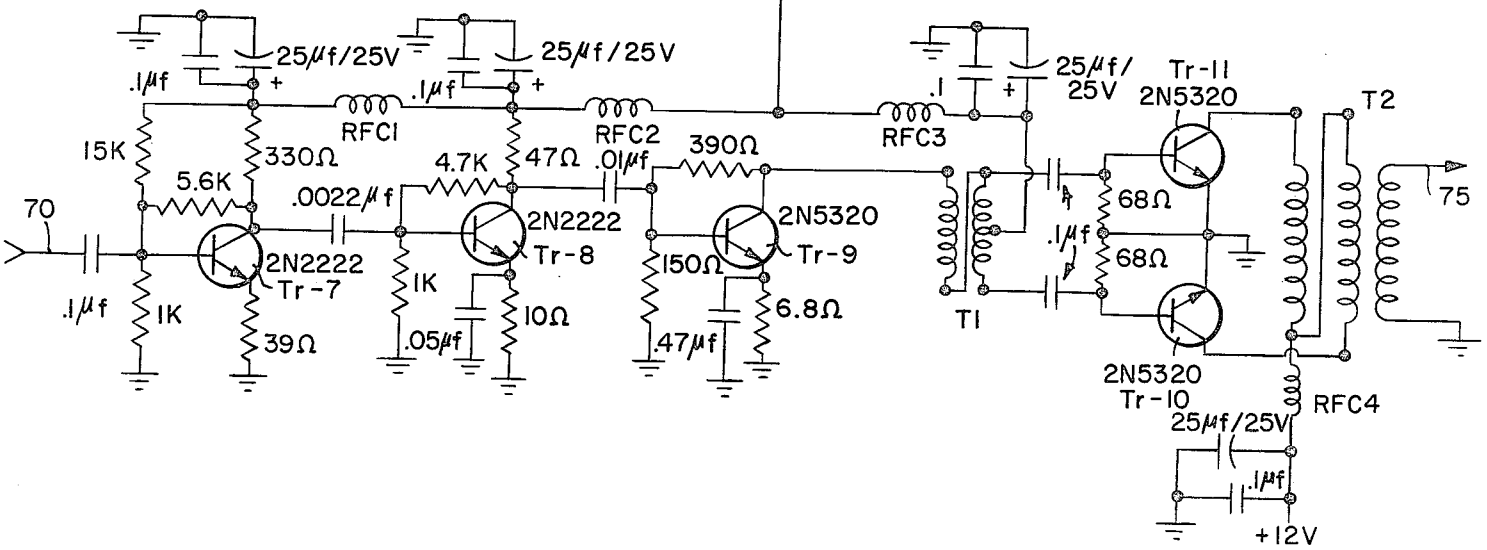
FIG. 7 is a schematic diagram for the AM transmitter buffer amplifier and power amplifier.

In the amplitude modulation buffer-amplifier section ABA of FIG. 7, the described sweeping output from the oscillator AVCO is applied at 70 through an input coupling capacitor to the first stage of a three-stage class A untuned R.F. amplifier section AB consisting of three transistor amplifiers Tr-7, Tr-8, Tr-9.

The R.F. output signal from the last stage of this section AB is coupled by transformer T-1 and capacitors to a broadband, push-pull, R.F. amplifier stage PA comprising transistors Tr-10 and Tr-11, which produces an R.F. output of about 5 watts; and this is fed to a broadband R.F. marching transformer T-2 coupling this signal into the AM antenna Aa, an AM loop antenna mounted on the vehicle.

Again the transmitted AM signal corresponds in center or nominal frequency, in sweep rate and the 4 Hz frequency modulation to that supplied by the voltage controlled oscillator AVCO, though again, as with the R.F. amplifier FBA for the frequency modulation transmission, with some wave shaping from square toward sinusoidal.

Reception

In a warned vehicle with radio set tuned to a station in a swept AM or FM broadcast band, the set will receive the warning broadcast R.F. signal with apparent reception strength peaking 400 times per second (twice per sweep cycle) for the assumed transmission conditions with 200 Hz sweep.

Where the warned vehicle receiver set is tuned to an FM station within the swept FM broadcast band, the set effectively sees the broadcast R.F. signal about 400 times per second for the assumed conditions, i.e., operation of the sweep generator centered at 200 Hz with the 4 Hz swing. The receiver audio output in effect is then pulsed 400 times per second and the speaker emits a correspondingly pitched sound with a "warble" at the 4 Hz rate.

Though there is no FM modulation for tone in the ordinary sense imposed on the R.F. transmitted FM carrier, the FM tuned receiver set provides an audio output with warble siren effect.

Similarly though there be in fact no amplitude modulation imposed on the triangular wave output of the generator G, hence none in the AM R.F. oscillator AVCO, a receiver set tuned to an AM band station sees the AM band signal about 400 times per second, and its audio stages and speaker are similarly pulsed, so that, as in the case of the FM band transmission and reception, the speaker emits acoustical pulses at about the 400 Hz rate but with a frequency swing derived from the 4 Hz frequency swing of the received R.F. signal. Hence the AM tuned receiver set provides an audio output which warble siren effect.

What is claimed is:

1. A warning alarm device capable of generating an audibly detectable warning signal in radio receivers which are within a predetermined transmission range and which are tuned to any frequency within a predetermined radio broadcast band, said warning alarm device including:

(a) a transmitting means for transmitting a carrier signal to any radio receiver operating within the transmission range and tuned to any discrete frequency within said predetermined radio broadcast band;

(b) a carrier signal generating means connected to said transmitting means for generating a RF carrier signal having no audio signal superimposed thereon at a discrete frequency which may vary over the entire predetermined radio broadcast band in response to a sweep signal and for supplying said transmitting means with said RF carrier signal;

and (c) a sweep signal generating means connected to said carrier signal generating means for supplying said carrier signal generating means with a sweep signal which causes said RF carrier signal to continuously sweep through each and every frequency within said predetermined radio broadcast band at a predetermined audio rate to generate an audible warning signal on any radio receiver which is within the transmission range and which is tuned to any distinct frequency within the broadcast band by the creation of only a single acoustical output pulse from the radio receiver each time said RF carrier signal passes through the discrete frequency to which the radio receiver is tuned, said acoustical output pulses forming the audible warning signal and occuring at a frequency proportional to said predetermined audio rate, whereby the warning alarm device provides radio receiver listeners with an audible warning of the proximity of said warning alarm device.

2. A device as described in claim 1, wherein said RF carrier signal has a discrete frequency which may be varied over a predetermined AM radio broadcast band.

3. A device as described in claim 1, wherein the frequency of said audibly detectable warning signal is directly proportional to said predetermined audio frequency.

4. A device as described in claim 1, wherein said predetermined audio frequency is at least 100 Hz.

5. A device as described in claim 1, wherein said sweep signal varies periodically at a fixed audio frequency.

6. A device as set forth in claim 1, wherein a tone generating means connected to said sweep signal generating means frequency modulates said sweep signal to vary the rate at which said RF carrier signal is swept through each and every frequency within said predetermined radio broadcast band to cause the tone of the audibly detectable warning signal produced in a receiving radio to vary periodically.

7. A device as set forth in claim 6, wherein the rate at which said RF carrier signal sweeps through each and every frequency within said predetermined radio broadcast band varies from 150 Hz to 450 Hz.

8. A device as set forth in claim 6, wherein said tone generating means which frequency modulates said sweep signal is a sawtooth wave generator producing an output signal in the low audio or sub-audio frequency range.

9. A device as set forth in claim 8, wherein said wave generator output signal has a frequency on the order of 4 Hz.

10. A device as set forth in claim 1, wherein said carrier signal generating means includes a voltage controlled oscillator with an output carrier base of center frequency varied by a triangular voltage wave produced as the output of said sweep signal generating means.

11. A device as described in claim 1, including a switch means for turning said carrier signal generating means and said sweep signal generating means on and off simultaneously with said warning device.

12. A device as set forth in claim 1, including a microphone, modulator and switching means for applying voice modulation to said RF carrier signal while simultaneously interrupting the warning signal transmission.

13. A warning alarm device capable of generating an audibly detectable warning signal in AM or FM radio receivers which are within a prdetermined transmission range and which are tuned respectively to any frequency within predetermined AM or FM radio broadcast band, said warning alarm device including:

(a) a transmitting means for transmitting AM and FM carrier signals to any radio receivers operating within the transmission range and tuned respectively to any discrete AM or FM frequency within said predetermined AM or FM radio broadcast bands;

(b) a carrier signal generating means connected to said transmitting means for generating a first RF carrier signal having no audio signal superimposed thereon at a discrete frequency which may be varied over the entire predetermined AM radio broadcast band in response to a sweep signal and for generating a second RF carrier signal having no audio signal superimposed thereon at a discrete frequency which may be varied over the entire predetermined FM radio broadcast band in response to a sweep signal, said carrier signal generating means also serving to supply said transmitting means with said first and second RF carrier signals;

and (c) a sweep signal generating means connected to said carrier signal generating means for supplying said carrier signal generating means with a sweep signal which respectively causes said first and second RF carrier signals to continuously sweep through each and every frequency within said predetermined AM and FM radio broadcast bands at a predetermined audio rate to generate first and second audible warning signals on any AM and FM radio receivers which are within the transmission range and which are tuned to any distinct frequency within the broadcast bands, respectively, by the creation of only a single first acoustic output pulse and only a single second acoustical output pulse, respectively, in the AM and FM radio receivers each time said first and second RF carrier signals, respectively, pass through the AM and FM frequencies to which the AM and FM radio receivers are tuned, said first acoustical output pulses forming the first audible warning signal and occuring at a frequency proportional to said predetermined audio rate and said second acoustical output pulses forming the second audible warning signal and also occuring at a frequency proportional to said predetermined audio rate, wherein the warning alarm device provides AM and FM radio receiver listeners with an audible warning of the proximity of said warning alarm device.

14. A device as set forth in claim 13, wherein said predetermined audio frequency is at least 100 Hz.

15. A device as described in claim 13, wherein said sweep signal varies periodically at a fixed audio frequency.

16. A device as set forth in claim 13, wherein a tone generating means connected to said sweep signal generating means frequency modulates said sweep signal to vary the rate at which said first and second RF carrier signals continuously sweep through each and every frequency within said predetermined radio broadcast band to cause the tone of the audibly detectable warning signal produced in a receiving radio to vary periodically.

17. A device as set forth in claim 16, wherein the rate at which the discrete frequency of said RF carrier signal is continuously swept through each and every frequency within said predetermined AM and FM radio broadcast band varies from 150 Hz to 450 Hz.

18. A device as set forth in claim 6, wherein said tone generating means which frequency modulates said sweep signal is a sawtooth wave generator producing an output signal in the low audio or sub-audio frequency range.

19. A device as set forth in claim 18, wherein said wave generator output signal has a frequency on the order of 4 Hz.

20. A device as set forth in claim 13, wherein said carrier signal generating means comprises a first voltage controlled oscillator for generating said AM frequency carrier signal and a second voltage controlled oscillator for generating said FM frequency carrier signal.

21. A device as described in claim 20, wherein the output carrier base or center frequency of each said voltage controlled oscillator is varried by a triangular wave voltage produced as the output of said sweep signal generating means.

22. A device as set forth in claim 13, in which said transmitting means includes a first antenna adapted for and energized by AM broadcast band power and a second antenna adapted for and energized by FM broadcast band power.

23. A device as described in claim 13, including a switch means for turning said carrier signal generating means and said sweep signal generating means on and off simultaneously with said warning device.

24. A device as set forth in claim 13, including a microphone, modulator, and switching means for applying voice modulation to said first and second RF carrier signals while simultaneously interrupting the warning signal transmission.

* * * * *